United States Patent [19]

Haggenmacher et al.

[11] 4,416,489

[45] Nov. 22, 1983

[54] CHISEL FOR A CRUST BREAKING FACILITY

[75] Inventors: Thomas Haggenmacher, Gampel; Edwin Gut, Steg; Hans Friedli, Steg; Gottfried Maugweiler, Steg, all of Switzerland

[73] Assignee: Swiss Aluminium Ltd., Chippis, Switzerland

[21] Appl. No.: 421,895

[22] Filed: Sep. 23, 1982

Related U.S. Application Data

[63] Continuation of Ser. No. 184,480, Sep. 5, 1980, abandoned.

[30] Foreign Application Priority Data

Sep. 10, 1979 [CH] Switzerland ..... 8150/79

[51] Int. Cl.[3] ..... C25C 3/14

[52] U.S. Cl. ..... 299/94; 204/245

[58] Field of Search ..... 299/37, 69, 70, 94, 299/91-93, 79; 266/137; 204/67, 245; 175/404, 416

[56] References Cited

U.S. PATENT DOCUMENTS

| | | | |
|---|---|---|---|
| 560,500 | 5/1896 | Hengen | 175/416 |
| 1,174,433 | 3/1916 | Mowlds | 299/91 |
| 1,880,623 | 10/1932 | Williams | 175/416 |
| 2,423,787 | 7/1947 | Mosena et al. | 299/37 X |
| 3,663,411 | 5/1972 | Springer | 204/243 R |
| 3,681,229 | 8/1972 | Lowe | 204/243 R |
| 4,280,573 | 7/1981 | Sudnishikov et al. | 175/404 X |

FOREIGN PATENT DOCUMENTS

| | | |
|---|---|---|
| 2135485 | 12/1972 | Fed. Rep. of Germany . |
| 520778 | 5/1972 | Switzerland . |

*Primary Examiner*—Ernest R. Purser

*Attorney, Agent, or Firm*—Bachman and LaPointe

[57] ABSTRACT

A chisel for a crust breaking facility for breaking through the solidified crust of electrolyte on an electrolytic cell, in particular a cell for producing aluminum, is such that at least a part of the edge region on the bottom face of the chisel projects out beyond the other regions and is in the form of cutting edges. The bottom face of the chisel features no faces which are inclined outwards and would create outward directed forces as the chisel is forced through the crust.

The chisel of the invention allows energy and investment costs to be reduced.

12 Claims, 8 Drawing Figures

CHISEL FOR A CRUST BREAKING FACILITY

This is a continuation, of application Ser. No. 184,480, filed Sept. 5, 1980 now abandoned.

BACKGROUND OF THE INVENTION

The present invention relates to a chisel for a crust breaking facility for breaking open the crust of solid electrolyte on an electrolytic cell, in particular on a cell for producing aluminum.

In the manufacture of aluminum from aluminum oxide, the latter is dissolved in a fluoride melt made up for the greater part of cryolite. The aluminum which separates out at the cathode collects under the fluoride melt on the carbon floor of the cell; the surface of this liquid aluminum acts as the cathode. Dipping into the melt from above are anodes which, in the conventional reduction process, are made of amorphous carbon. As a result of the electrolytic decomposition of the aluminum oxide, oxygen is produced at the carbon anodes; this oxygen combines with the carbon in the anodes to form $CO_2$ and CO. The electrolytic process takes place in a temperature range of approximately 940°–970° C.

The concentration of aluminum oxide decreases in the course of the process. At an $Al_2O_3$ concentration of 1–2 wt. % the so-called anode effect occurs producing an increase in voltage from e.g. 4–4.5 V to 30 V and more. Then at the latest the crust must be broken open and the concentration of aluminum oxide increased by adding more alumina to the cell.

Under normal operating conditions the cell is fed with aluminum oxide regularly, even when no anode effect occurs. Also whenever the anode effect occurs the crust must be broken open and the alumina concentration increased by the addition of more aluminum oxide; this is called servicing the cell.

For many years now servicing the cell includes breaking open the crust of solidified melt between the anodes and the side ledge of the cell and then adding fresh aluminum oxide. This procedure, which is still widely practiced today, is being criticized increasingly because of the pollution of the air in the pot room and the air outside. In recent years therefore it has become increasingly necessary and obligatory to hood over or encapsulate the reduction cells and to treat the exhaust gases. It is however not possible to capture completely all the exhaust gases by hooding the cells if the cells are serviced in the classical manner between the anodes and the sides of the cells.

More recently therefore aluminum producers have been going over to servicing the cells at the longitudinal axis of the cell. After breaking open the crust, the alumina is fed to the cell either locally and continuously according to the point feeder principle or discontinuously along the whole of the central axis of the cell. In both cases a storage bunker for alumina is provided above the cell. The same applies for the transverse cell feeding proposed recently by the applicant in U.S. Pat. No. 4,172,018.

The breaking open of the solidified electrolyte is carried out with conventional, well known devices provided with chisels which are rectangular or round in cross section.

The lower part of the chisel which comes into direct contact with the crust on breaking it open is shaped as follows:

flat end face lying perpendicular to the sidewalls of the chisel (Swiss Pat. No. 520,778). This shape of chisel can be regarded as the normal shape, round chisel with a conical point (German Pat. No. 2,135,485), flat conical end to a round chisel (U.S. Pat. No. 3,371,026).

The disadvantage of flat ended chisels is that the relatively hard and thick electrolyte crust has to be pushed down at the same time over the whole cross section of the tool. With chisels which have tapered ends the vertical force to be applied is indeed smaller. However, because of the wedge effect of the inclined sides, there are still significant forces acting sideways to be overcome. This increases considerably the energry required, and the investment costs.

SUMMARY OF THE INVENTION

It is therefore an object of the invention to develop a shape of chisel for a device for breaking the solidified crust on an electrolytic cell, such that the force required for breaking through the crust is considerably reduced.

This object is achieved by way of the invention in that at least parts of the edge regions of the bottom face of the chisel project beyond the other regions and are shaped as cutting edges, and that this face of the chisel does not feature any areas which are inclined outwards and would create outward acting forces on pushing through the crust.

In use a chisel with its bottom face shaped according to the invention acts as a stamping or shearing tool on breaking through the electrolyte crust. The smaller force required to penetrate the crust reduces the amount of energy needed for this and also makes it possible to employ a less massive crust breaker which allows investments to be kept down.

The chisels are made of normal materials, preferably from St 40–50, a hard, weldable steel. Chisels of rectangular cross section e.g. 150×40 mm are particularly favorable for central, transverse or point feeding (which are called for increasingly for environmental reasons), as the anode spacing in the longitudinal axis of the cell (central feed) and transverse axis (transverse feed) does not, or only minimally, require adjustment when modifying existing cells.

For reasons of manufacture conical, blunted cone or shaped recesses are preferred in chisels which are round in cross section, and wedge-shaped recesses in chisels which are rectangular in cross section.

The crust breaking facility which comprises in principle a pressure cylinder, piston rod and chisel is mounted directly or indirectly on the superstructure of the cell or is a component part of a cell feeding vehicle or manipulator.

BRIEF DESCRIPTION OF THE DRAWING

Exemplified embodiments of the invention are illustrated schematically in the following viz.

DETAILED DESCRIPTION

Figure 1:
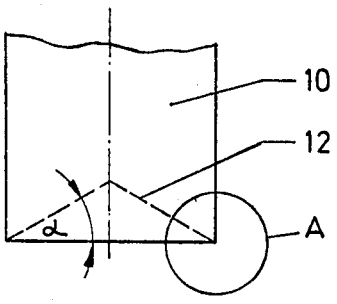
FIGS. 1 and 2: A bell-shaped chisel with conical recess (end view and plan view from underneath).
Figure 2:
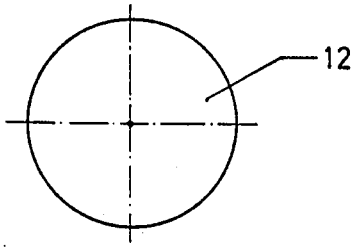

FIGS. 1 and 2 show a cylindrical shaped chisel 10 which, instead of a flat bottom face, features a conical recess 12 and substantially parallel side walls adjacent said recess. The face of this conical recess 12 and the sidewall of the cylinder 10 form a circular cutting edge which can be seen from underneath and represents the working edge. The inclined face of the conical recess 12 forms an angle $\alpha$ with the horizontal which lies preferably in the range 15°–45°. The effectiveness of the working edge decreases progressively with decreasing angle; larger angles than 45° are of less interest for economic and strength reasons.

On lowering the chisel 10 a circular hole is stamped out of the crust of solidified electrolyte. On engaging with the crust no outward directed components of force are created. The lateral forces developed by the face of the cone 12 are directed inwards and act therefore on the part of the crust which has to be pushed through.

Figure 3:
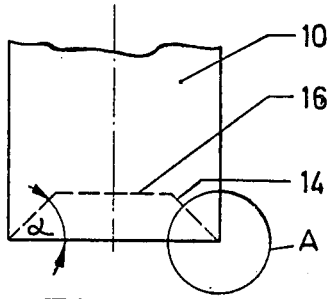
FIGS. 3 and 4: A bell-shaped chisel with blunted cone recess (end view and plan view from underneath).
Figure 4:
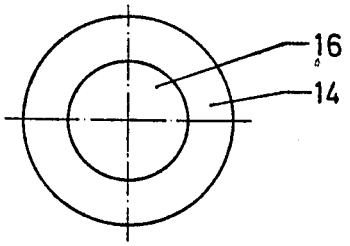

If the recess in a cylindrical chisel 10 such as in FIGS. 3 and 4 is in the form of a blunted cone, the sloping face 14 of the cone has the same effect as the cone face 12 in FIG. 1. The horizontal face 16 exerts its exclusively downward directed force only after the chisel has already been pushed a certain distance into the crust.

Figure 5:
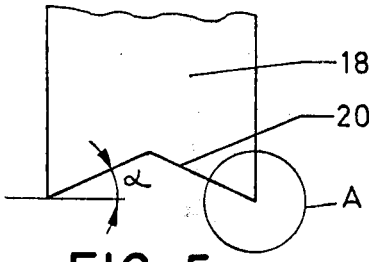
FIGS. 5 and 6: A fish-tail-shaped chisel (end view and plan view from underneath).
Figure 6:
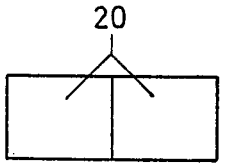

FIGS. 5 and 6 show a chisel 18 which is rectangular in cross section and which features a wedge-shaped recess 20 on the end face 20 instead of a horizontal face. The same criteria as for the previous figures hold for the selection of the angle of inclination $\alpha$ of this fish-tail form. The triangular shaped part removed from the plane shown in FIG. 5 can, in a version not shown here, also be trapezium-shaped similar to that in FIG. 3.

Figure 7:
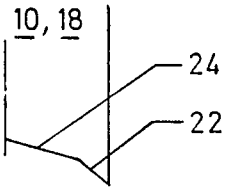
FIGS. 7 and 8: Other versions of the edge regions A in FIGS. 1, 3 and 5.

In FIG. 7 another version of the working edge of the chisel is shown on an enlarged scale. The recess, regardless of whether it is conical or wedge-shaped runs initially at a steeper angle 22 and then changes over to a less steep angle 24. This has the advantage that the chisel can be pushed into the crust with less force. However only very hard and wear-resistant chisel materials are suitable for this version.

Figure 8:
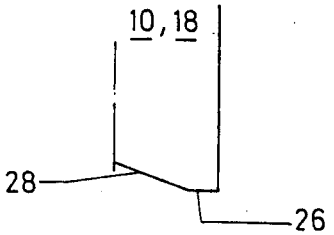

FIG. 8 shows a further version of the working edge of the chisel. The recess does not begin at the periphery of the chisel, but slightly inwards from the edge so that a flat, horizontal surface 26 exists at the edge. At the inner edge of this flat region the recess 28 begins, preferably running at the angle $\alpha$ of magnitude mentioned above. With this shape of chisel more force has to be exerted initially on impressing the chisel into the crust; the degree of wear on the chisel material on the other hand is less.

It is understood of course that the advantages of the invention can also be achieved with other shapes of recess on the bottom face of the chisel, provided no outward directed forces are produced.

What is claimed is:

1. Breaking device for a crust breaking facility for breaking the solidified crust of solid electrolyte on an electrolytic cell for the production of aluminum which comprises a chisel having a bottom face and edge regions thereof, wherein at least parts of the edge regions of the chisel project beyond the other regions of said chisel and are shaped as cutting edges to form a recess in said bottom face, including inclined portions extending inwardly from said edge portions such that the bottom face of the chisel does not feature any areas which are inclined outwards which would create outwardly acting forces concurrent with pushing the chisel through the crust, thereby the force required for breaking through the crust is considerably reduced, the lateral forces are directed inwardly and a circular hole in the crust is developed.

2. Chisel according to claim 1 wherein said chisel is cylindrical in shape and on the bottom face features a recess having a shape selected from the group consisting of conical, blunted cone and hemispherical, said recess extending up to said edge region.

3. Chisel according to claim 2 wherein the angle of inclination ($\alpha$) of the faces of the recess lies between 15° and 45°.

4. Chisel according to claim 2 wherein said chisel has a conical shape.

5. Chisel according to claim 1 wherein said chisel is rectangular in cross section and features on the bottom face a wedge-shaped recess which extends up to said edge region.

6. Chisel according to claim 5 wherein the angle of inclination ($\alpha$) of the faces of the recess lies between 15° and 45°.

7. Chisel according to claim 1 wherein adjacent said cutting edge a first recess is provided which features a large angle of inclination and a second recess is provided adjacent said first recess which has a smaller angle of inclination.

8. Chisel according to claim 1 wherein the bottom face of the chisel features a horizontal edge zone surrounding a recess.

9. Chisel according to claim 1 wherein the angle of said inclined portions is between 15° and 45°.

10. Chisel according to claim 1 wherein said chisel has substantially parallel side walls adjacent said recess.

11. Breaking device for breaking the crust of solidified melt on an electrolytic cell for the production of aluminum which comprises a chisel having a bottom face and edge regions thereof, wherein at least parts of the edge regions of the bottom face of the chisel project beyond the other regions of said chisel and are shaped as cutting edges to form a recess in said bottom face, including inclined portions extending inwardly from said edge portions, the angle of said inclined portions lying between 15° and 45°, such that the bottom face of the chisel does not feature any areas which are inclined outwards which would create outwardly acting forces concurrent with punching the chisel through the crust, thereby the force required for punching through the crust is considerably reduced, the lateral forces are directed inwardly and a circular hole in the crust is developed.

12. Chisel according to claim 11 wherein said chisel has substantially parallel side walls adjacent said recess.

* * * * *